US005124598A

United States Patent [19]

Kawamura

[11] Patent Number: 5,124,598

[45] **Date of Patent: * Jun. 23, 1992**

[54] INTAKE/EXHAUST VALVE ACTUATOR

[75] Inventor: Hideo Kawamura, Samukawa, Japan

[73] Assignee: Isuzu Ceramics Research Institute Co., Ltd., Japan

[ * ] Notice: The portion of the term of this patent subsequent to Jul. 24, 2007 has been disclaimed.

[21] Appl. No.: 516,707

[22] Filed: Apr. 30, 1990

[30] Foreign Application Priority Data

Apr. 28, 1989 [JP] Japan ..... 1-111368

[51] Int. Cl.[5] ..... H02K 41/00; F01L 9/04; H01F 7/16

[52] U.S. Cl. ..... 310/30; 310/15; 251/129.1; 123/90.11

[58] Field of Search ..... 310/15, 28, 30; 251/65, 251/129.1, 129.04; 123/90.11

[56] References Cited

U.S. PATENT DOCUMENTS

| | | | |
|---|---|---|---|
| 4,475,494 | 10/1984 | Huther | 123/188 AA |
| 4,533,890 | 8/1985 | Patel | 310/30 |
| 4,614,170 | 9/1986 | Pischinger et al. | 251/129.1 |
| 4,719,882 | 1/1988 | Kreuter | 123/90.11 |
| 4,777,915 | 10/1988 | Bonvallet | 123/90.11 |
| 4,779,582 | 10/1988 | Lequesne | 123/90.11 |
| 4,794,890 | 1/1989 | Richeson, Jr. | 123/90.11 |
| 4,938,179 | 7/1990 | Kawamura | 123/90.11 |
| 4,942,851 | 7/1990 | Kawamura | 123/90.11 |

FOREIGN PATENT DOCUMENTS

| | | | |
|---|---|---|---|
| 281192 | 9/1988 | European Pat. Off. . | |
| 32455585 | 6/1984 | Fed. Rep. of Germany | 123/90.11 |
| 56-74080 | 6/1981 | Japan . | |
| 58-101206 | 6/1983 | Japan . | |
| 61-76713 | 4/1986 | Japan . | |
| 568216 | 3/1945 | United Kingdom . | |

*Primary Examiner*—Steven L. Stephan
*Assistant Examiner*—Dennis R. Haszko
*Attorney, Agent, or Firm*—Staas & Halsey

[57] ABSTRACT

An intake/exhaust valve actuator includes a movable permanent magnet coupled to the shank end of an intake/exhaust valve, a first fixed electromagnet having a plurality of fixed magnetic poles confronting a side of the movable permanent magnet, for opening and closing the intake/exhaust valve under an electromagnetic force developed between the movable permanent magnet and the fixed magnetic poles, a second fixed electromagnet having a fixed magnetic pole which confronts an end surface of the movable permanent magnet when the intake/exhaust valve is closed, the second fixed electromagnet having an excitation coil, an induction coil connected to the excitation coil of the second fixed electromagnet, for supplying electric energy to the excitation coil, a resonant circuit comprising a primary coil positioned in confronting relation to the induction coil and a capacitor connected to the primary coil, and control means for supplying electric energy to the resonant circuit when the intake/exhaust valve starts being opened and immediately before the intake/exhaust valve is seated, thereby to develop a repelling magnetic force between the fixed magnetic pole of the second fixed electromagnet and the movable permanent magnet. As the rotational speed of the engine increases, the intake/exhaust valve is driven at a large acceleration necessary to open the intake/exhaust valve. When the rotational speed of the engine is lower, the acceleration to open the intake/exhaust valve is reduced. When the valve closing stroke ends, a certain acceleration is given in the direction to open the intake/exhaust valve.

4 Claims, 2 Drawing Sheets

INTAKE/EXHAUST VALVE ACTUATOR

BACKGROUND OF THE INVENTION

1. Field of the Invention:

The present invention relates to an intake/exhaust valve actuator for actuating an intake or exhaust valve which controls the flow of intake air into or exhaust gases from an engine.

2. Description of the Prior Art:

Conventional actuators for opening and closing intake or exhaust valves usually comprise camshafts and link mechanisms which are incorporated in engines. Therefore, the engines with such conventional intake/exhaust valve actuators are relatively large in size. Since the camshaft is driven by the output shaft of the engine, part of the output power of the engine is consumed by the frictional resistance to the camshafts and the link mechanisms when they are driven. Accordingly, the effective output power to drive road wheels is lowered. As it is difficult to vary the timing with which the intake or exhaust valve is opened and closed, depending on the rotational speed of the engine, the valve opening/closing timing is adjusted at a certain engine rotational speed. As a result, the output power of the engine and its efficiency are reduced when the engine operates at a higher or lower rotational speed.

The above problems can be solved by electromagnets for electromagnetically opening and closing intake or exhaust valves.

Known electromagnetic intake/exhaust valve actuators are disclosed in Japanese Laid-Open Patent Publications Nos. 58(1983)-183805 and 61(1986)-76713, for example. The disclosed valve actuators comprise a movable magnetic pole on the shaft of an intake or exhaust valve, and another magnetic pole fixed to the engine. The valve shaft can be axially moved reciprocally under magnetic forces produced between these magnetic poles, so that the valve can be opened and closed under the control of the valve actuator.

While an intake or exhaust valve is being opened or closed, it can be controlled with a small drive force. However, when the valve is to be opened, it has to be driven against the pressure developed in the engine cylinder, and hence a large drive force is generally required in a direction to open the valve. When the valve closing operation is finished, the valve should be seated on the valve seat without a large shock because the valve would otherwise have a shortened service life. Accordingly, a large drive force is also required in the direction to open the valve in order to decelerate the valve when it is seated.

The intake/exhaust valve actuators disclosed in the above two publications do not have any arrangement for strengthening the valve drive force when the valve starts being opened and stops its closing stroke. Even if a valve opening command is given to the valve at certain timing in response to detection of a crankshaft angle, the valve actuator starts to operate the valve with a certain time lag irrespective of the rotational speed of the engine. Consequently, it is difficult to open and close the valve at such timing that the efficiency of the engine is maximum.

It is necessary to apply a sufficiently large initial drive force to the valve and also to increase the drive force with the rotational speed of the engine. However, an electromagnetic valve actuator for generating electromagnetic forces to produce such drive forces for the control of the opening and closing of an intake or exhaust valve would be large in size.

SUMMARY OF THE INVENTION

In view of the aforesaid problems of the conventional intake/exhaust valve actuators, it is an object of the present invention to provide an intake/exhaust valve actuator which can apply a large drive force in a direction to open an intake or exhaust valve when the valve starts its opening stroke and stops its closing stroke.

According to the present invention, the above object can be achieved by an intake/exhaust valve actuator for electromagnetically opening and closing an intake/exhaust valve in an engine, comprising a movable permanent magnet coupled to the end of a shank of the intake/exhaust valve, a first fixed electromagnet having a plurality of fixed magnetic poles confronting a side of the movable permanent magnet, for opening and closing the intake/exhaust valve under an electromagnetic force developed between the movable permanent magnet and the fixed magnetic poles, a second fixed electromagnet having a fixed magnetic pole which confronts an end surface of the movable permanent magnet when the intake/exhaust valve is closed, the second fixed electromagnet having an excitation coil, an induction coil connected to the excitation coil of the second fixed electromagnet, for supplying electric energy to the excitation coil, a resonant circuit comprising a primary coil positioned in confronting relation to the induction coil and a capacitor connected to the primary coil, and control means for supplying electric energy to the resonant circuit when the intake/exhaust valve starts being opened and immediately before the intake/exhaust valve is seated, thereby to develop a repelling magnetic force between the fixed magnetic pole of the second fixed electromagnet and the movable permanent magnet.

As the rotational speed of the engine increases, the intake/exhaust valve is driven at a large acceleration necessary to open the intake/exhaust valve. When the rotational speed of the engine is lower, the acceleration to open the intake/exhaust valve is reduced. When the valve closing stroke ends, a certain acceleration is given in the direction to open the intake/exhaust valve. Therefore, the electromagnetically driven intake/exhaust valve can be opened and closed with optimum drive forces irrespective of the rotational speed of the engine. The intake/exhaust valve can be opened and closed at optimum timing by the intake/exhaust valve actuator which is relatively small in size and simple in structure.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
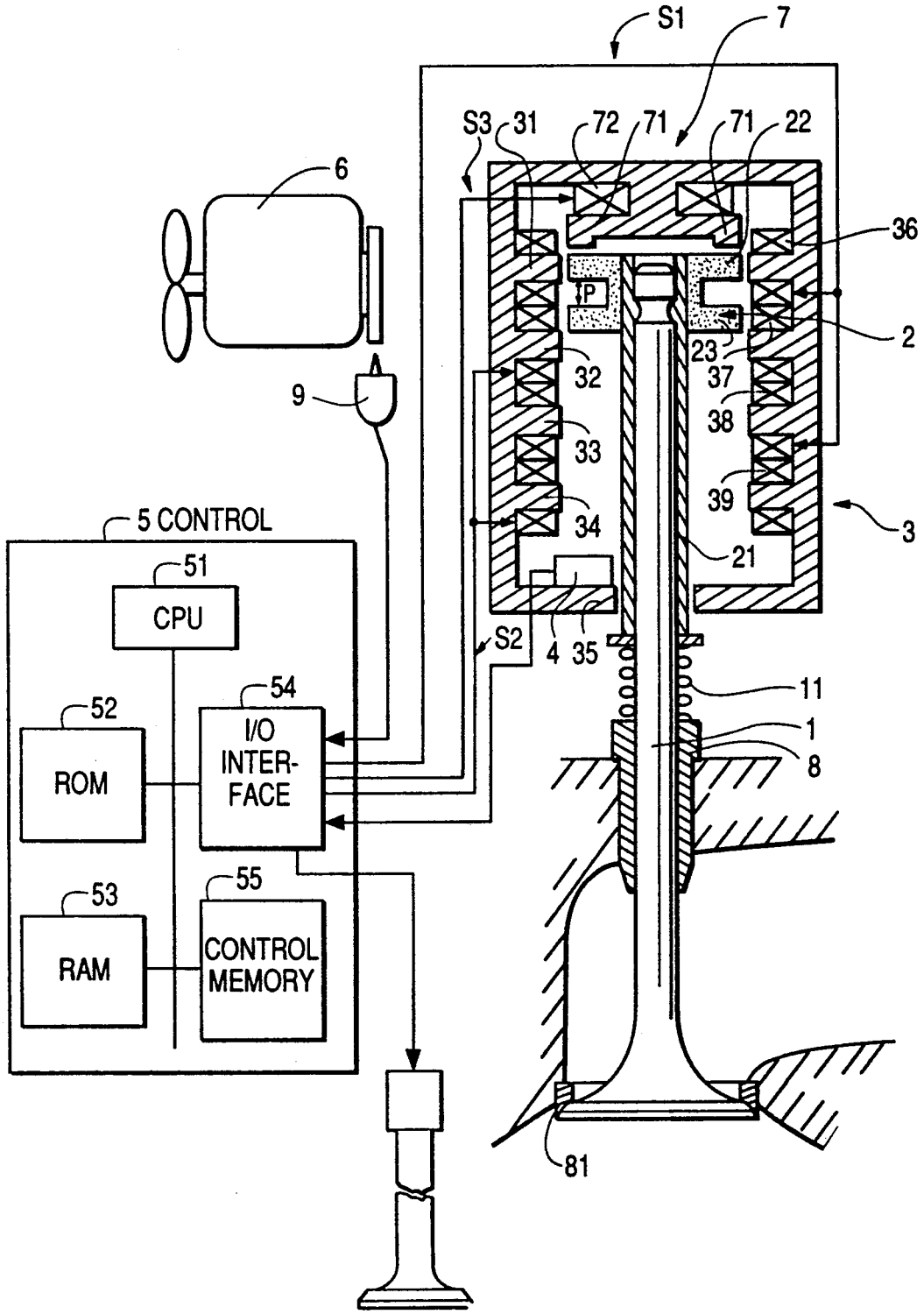
FIG. 1 is a cross-sectional view, partly in block form, of an intake/exhaust valve actuator according to the present invention.

FIG. 1 shows an exhaust valve actuator according to the present invention, which is incorporated in an engine 6 for a motor vehicle, for example.

As shown in FIG. 1, an exhaust valve 1 which is incorporated in the engine 6 is made of a high-strength lightweight material such as a ceramic material or the like. The exhaust valve 1 supports a circular permanent magnet 2 fitted over the upper end of its shaft or shank, the permanent magnet 2 serving as a movable magnetic pole. The upper end portion of the shank of the exhaust valve 1 is covered with a cylindrical magnetic member 21 serving as a magnetic passage. The outer circumferential surface of the magnetic passage 21 confronts an electromagnet 3 fixed to an engine body, the electromagnet 3 serving as a fixed magnetic pole.

The electromagnet 3 has a position sensor 4 for detecting the position of the exhaust valve 1 as it moves and generating a position signal indicating the detected position of the exhaust valve 1. The position sensor 4 is electrically connected to a control unit 5 which electronically controls the engine.

An upper electromagnet 7 for accelerating opening movement, i.e., downward movement, of the exhaust valve 1 is fixedly disposed upwardly of the electromagnet 3. The upper electromagnet 7 comprises an upper magnetic pole 71 which confronts the upper shank end of the exhaust valve 1 with a small gap therebetween, when the exhaust valve 1 is closed, i.e., in its uppermost position, and an upper coil 72 wound around the upper magnetic pole 71.

The shank of the exhaust valve 1 is axially reciprocally supported in the cylinder head of the engine 6 by a valve guide 8. The engine 6 has an exhaust passage including an exhaust port which opens into an engine cylinder and has a valve seat 81. The exhaust port is closed when the valve head of the exhaust valve 1 is closely held against, i.e., seated on, the valve seat 81. A rotation sensor 9 for detecting the rotational speed and angular position of the output shaft of the engine 6 and for converting the detected speed and angular position into a signal, is disposed near the output shaft of the engine 6. The rotation sensor 9 detects the crankshaft angle of the engine 6 and applies a crankshaft angle signal to the control unit 5, which then determines opening timing for the exhaust valve 1 based on the supplied signal. The control unit 5 controls the upper electromagnet 7 depending on the rotational speed of the engine 6 for the control of the acceleration of movement of the exhaust valve 1.

Although not shown, the engine 6 also has other exhaust valves and intake valves, which are structurally identical to the exhaust valve 1, for opening and closing corresponding exhaust and intake ports (not shown). The shanks of these intake and exhaust valves are axially reciprocally moved under magnetic forces produced between permanent magnets and electromagnets, identical to those shown in FIG. 1, for controlling the opening and closing of the exhaust and intake ports.

The permanent magnet 2 has two juxtaposed magnetic poles 22, 23 which are spaced from each other by a distance P in the axial direction of the exhaust valve 1. The magnetic pole 22, which is located closer to the upper shank end, is an S pole, whereas the other magnetic pole 23 is an N pole.

The electromagnet 3 is disposed in confronting relation to the magnetic poles 22, 23 of the permanent magnet 2. The electromagnet 3 has four juxtaposed salient magnetic poles 31, 32, 33, 34, the adjacent two of which are spaced by a distance of (4/3)P in the axial direction of the exhaust valve 1, a fixed magnetic pole 35 disposed in confronting relation to the outer circumferential surface of the magnetic passage 21, and coils 36, 37, 38, 39 wound respectively around the salient magnetic poles 31, 32, 33, 34. The coils 36, 38 and the coils 37, 39 are wound in opposite directions.

A spring 11 is disposed between the magnetic passage 21 and the valve guide 8, for normally holding the exhaust valve 1 from dropping downwardly when the electromagnet 3 is de-energized. The control unit 5 comprises an input/output interface 54, a RAM 53 for temporarily storing data and the results of arithmetic operations, a ROM 52 for storing a control program and various maps, a CPU 51 for carrying out arithmetic operations according to the control program stored in the ROM 52, and a control memory 55 for controlling the flow of signals in the control unit 5.

The control units 5 produces signals for driving the exhaust valve 1. More specifically, the control unit 5 sends a signal S1 to the coils 36, 38, a signal s2 to the coils 37, 39, and a signal S3 to the upper coil 72 of the upper electromagnet 7.

An energization circuit for energizing the upper electromagnet 7 will be described below with reference to FIG. 2.

The upper coil 72 of the upper electromagnet 7 is connected to the positive terminal of a power supply B through a resistor R2 and a secondary coil L2. The secondary coil L2 and a primary coil L1 jointly constitute a transformer. The junction between the secondary coil L2 and the upper coil 72 is connected to a terminal SW2 of a selector switch SW.

The primary coil L1 has one terminal connected to the positive terminal of the power supply B, and the other terminal connected to the negative terminal of the power supply B through a parallel-connected circuit composed of a terminal SW1 of the selector switch SW and a variable capacitor Co.

Figure 2:
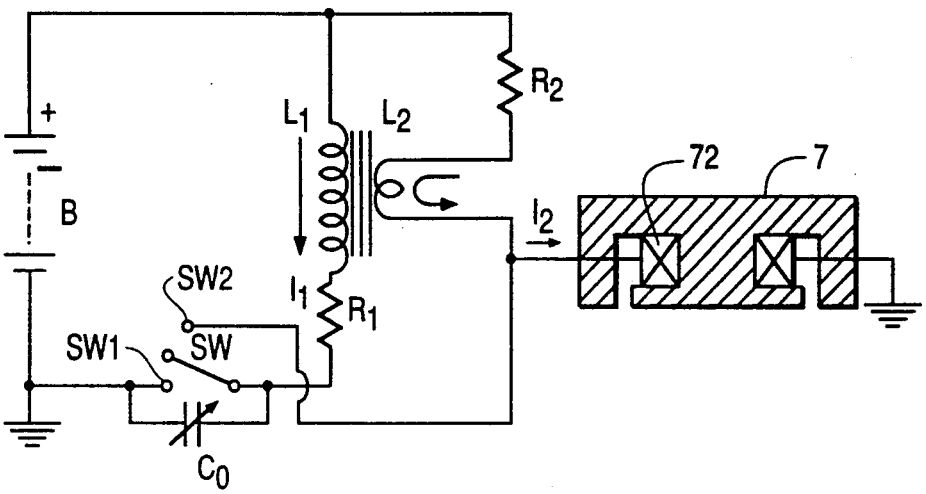
FIG. 2 is a circuit diagram of an energization circuit for accelerating the opening movement of a valve.

The signal S3 is applied to the energization circuit shown in FIG. 2 such that the signal S actuates the selector switch SW and also varies the electrostatic capacitance of the variable capacitor Co.

When a primary current I1 flows through the primary coil L1 at suitable timing in response to the signal S3, a secondary current I2 flows through the secondary coil L2, thus energizing the upper magnetic pole 71 of the upper electromagnet 7 into an N pole. Since a repelling magnetic force is developed between the upper magnetic pole 71 and the N magnetic pole 22, the permanent magnet 2 on the exhaust valve 1 is accelerated in a direction to open the exhaust valve 1.

The electrostatic capacitance of the variable capacitor Co which is parallel to the selector switch SW is increased by the signal S3 as the rotational speed of the engine 6 increases. Therefore, when the rotational speed of the engine 6 increases, a larger secondary current I2 is supplied to the upper coil 72. More specifically, when the terminal SW2 is turned off, a series resonant circuit composed of the primary coil L1, the resistor R1, and the variable capacitor Co is established. A transient current which flows in the series resonant circuit to the primary coil L1 is controlled by the capacitance of the variable capacitor Co which is controlled by the signal S3 depending on the rotational speed of the engine 6.

The relationship between the valve lift, the secondary current I2, and the crankshaft angle will be described with reference to FIG. 3.

Figure 3:
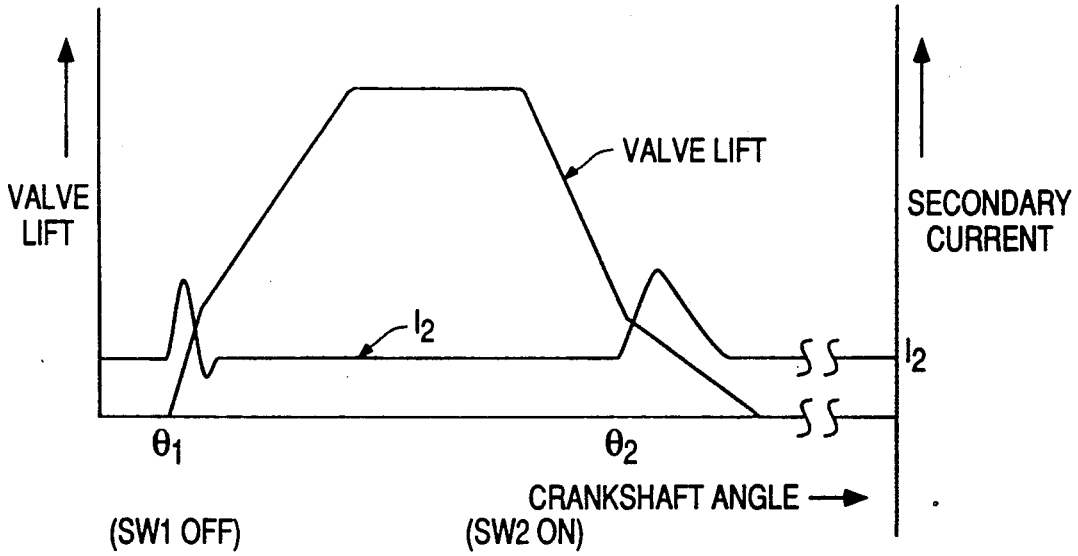
FIG. 3 is a graph showing the relationship between a valve lift, a crankshaft angle, and a secondary current.

The graph of FIG. 3 has a horizontal axis representing the crankshaft angle, and a vertical axis representing the valve lift on the left and the secondary current I2 on the right.

When the crankshaft angle ($\theta$) detected by the rotation sensor 9 reaches a timing ($\theta 1$) for opening the exhaust valve 1, the control unit 5 calculates a speed to open the exhaust valve 1 and a valve lift by which the exhaust valve is to be opened, based on a map stored in the ROM 52 according to a signal indicating the rotational speed of the engine 6 and a signal (not shown) indicating the amount of depression of the accelerator pedal associated with the engine 6. Then, based on the results of the calculations, the control unit 5 produces the signals S1, S2 and also the signal S3. The signal S3 is applied to the excitation circuit shown in FIG. 2, turning off the terminal S1 of the selector switch SW. A primary current I1 now flows through the primary coil L1 and induces a large secondary current I2 across the secondary coil L2, which is supplied to the upper coil 72 of the upper electromagnet 7.

Therefore, as the rotational speed of the engine 6 goes higher, the drive force to drive the exhaust valve 1 is increased. The exhaust valve 1 can thus be driven with a large acceleration which is required to open the exhaust valve 1. When the rotational speed of the engine 6 is lower, the acceleration with which to open the exhaust valve 1 is lowered.

After the exhaust valve 1 has been held in the open position with the calculated valve lift, the exhaust valve 1 is driven in the closing direction to close the exhaust port. At this time, the terminal SW2 of the selector switch SW is turned on at a predetermined crankshaft angle ($\theta 2$) by the signal SW3, supplying the electric energy stored in the variable capacitor Co to the upper coil 72. As a consequence, when the closing stroke of the exhaust valve 1 ends, the exhaust valve 1 is accelerated in the valve opening direction, i.e., decelerated in the valve closing direction.

As described above, the exhaust valve 1 is driven at the acceleration depending on the rotational speed of the engine 6, so that the exhaust valve 1 is opened under the repelling magnetic force against the pressure developed in the combustion chamber in the engine cylinder. The exhaust port is now opened, and the exhaust gases are discharged from the combustion chamber through the exhaust port. Then, the pressure in the combustion chamber rapidly drops, after which the exhaust valve 1 can be driven under a smaller drive force. When the exhaust valve 1 is seated again on the valve seat 81, the exhaust valve 1 is decelerated in the valve closing direction, and thus any shock or impact to which the exhaust valve 1 and the valve seat 81 are subjected to when the exhaust valve 1 is seated is reduced.

While the principles of the present invention have been described with particular reference to an exhaust valve, the present invention is also applicable to the actuation of an intake valve. In the following claims, the term "intake/exhaust valve" is used to cover either an intake valve or an exhaust valve or both intake and exhaust valves.

Although a certain preferred embodiment has been shown and described, it should be understood that many changes and modifications may be made therein without departing from the scope of the appended claims.

What is claimed is:

1. An intake/exhaust valve actuator for electromagnetically opening and closing an intake/exhaust valve in an engine, comprising:

a movable permanent magnet coupled to the end of a shank of the intake/exhaust valve;

a first fixed electromagnet having a plurality of fixed magnetic poles confronting a side of said movable permanent magnet, for opening and closing said intake/exhaust valve under an electromagnetic force developed between said movable permanent magnet and said fixed magnetic poles;

a second fixed electromagnet having a fixed magnetic pole which confronts an end surface of said movable permanent magnet when said intake/exhaust valve is closed, said second fixed electromagnet having an excitation coil;

an induction coil connected to the excitation coil of said second fixed electromagnet, for supplying electric energy to said excitation coil;

a resonant circuit comprising a primary coil positioned in confronting relation to said induction coil and a capacitor connected to said primary coil; and control means for supplying electric energy to said resonant circuit when said intake/exhaust valve starts being opened and immediately before said intake/exhaust valve is seated, thereby to develop a repelling magnetic force between the fixed magnetic pole of said second fixed electromagnet and said movable permanent magnet.

2. An intake/exhaust valve actuator according to claim 1, wherein said capacitor comprises a variable capacitor whose electrostatic capacitance is variable depending on the rotational speed of the engine.

3. An intake/exhaust valve actuator according to claim 1, wherein said intake/exhaust valve is made of a ceramic material.

4. An intake/exhaust valve actuator according to claim 1, wherein said movable permanent magnet has two magnetic poles which are juxtaposed in a direction in which the intake/exhaust valve is movable.

* * * * *

UNITED STATES PATENT AND TRADEMARK OFFICE

CERTIFICATE OF CORRECTION

PATENT NO. : 5,124,598

DATED : June 23, 1992

INVENTOR(S) : HIDEO KAWAMURA

It is certified that error appears in the above-identified patent and that said Letters Patent is hereby corrected as shown below:

TITLE PAGE [56] FOREIGN PATENT DOCUMENTS "32455585" should be --3245585--.

Signed and Sealed this

Tenth Day of August, 1993

*Attest:*

Michael K. Kirk

MICHAEL K. KIRK

*Attesting Officer*

*Acting Commissioner of Patents and Trademarks*